US006104742A

United States Patent [19]

Carter, Jr. et al.

[11] Patent Number: 6,104,742

[45] Date of Patent: Aug. 15, 2000

[54] ELECTROSLAG APPARATUS AND GUIDE

[75] Inventors: William Thomas Carter, Jr., Galway; Robert John Zabala, Schenectady; Bruce Alan Knudsen, Amsterdam; Howard Roscoe Hart, Jr., Schenectady; Mark Gilbert Benz, Burnt Hills, all of N.Y.

[73] Assignee: General Electric Company, Schenectady, N.Y.

[21] Appl. No.: 08/996,715

[22] Filed: Dec. 23, 1997

[51] Int. Cl.[7] ..... H05B 3/60

[52] U.S. Cl. ..... 373/42; 373/45; 373/67; 266/201; 75/10.24

[58] Field of Search ..... 373/42, 43, 44, 373/45, 56, 57, 59, 142, 156, 67; 266/201, 202, 204, 205; 75/10.11, 10.24

[56] References Cited

U.S. PATENT DOCUMENTS

| | | | |
|---|---|---|---|
| 2,532,389 | 12/1950 | Batcheller | 373/59 |
| 3,389,208 | 6/1968 | Roberts et al. | 373/59 |
| 5,160,532 | 11/1992 | Benz et al. | 75/10.24 |
| 5,310,165 | 5/1994 | Benz et al. . | |
| 5,325,906 | 7/1994 | Benz et al. . | |
| 5,332,197 | 7/1994 | Benz et al. . | |
| 5,348,566 | 9/1994 | Sawyer et al. . | |
| 5,366,206 | 11/1994 | Sawyer et al. . | |
| 5,544,195 | 8/1996 | Hardt et al. | 373/79 |
| 5,563,904 | 10/1996 | Colpo et al. | 373/146 |

*Primary Examiner*—Tu Ba Hoang
*Attorney, Agent, or Firm*—Noreen C. Johnson; Douglas E. Stoner

[57] ABSTRACT

A melt guide is provided for enclosing a bottom of an electroslag refining crucible containing a melt of electroslag refined metal. The guide includes an upper plate sized to engage the crucible bottom for attachment thereto, and includes an upper orifice drain therethrough for draining by gravity the melt from the crucible. A lower plate is spaced below the upper plate to define a plenum therebetween, and includes a lower orifice drain therethrough. A downspout extends through the plenum in flow communication between the upper and lower drains, and includes a middle orifice drain. A heater surrounds the downspout for heating the melt drainable therethrough. And, a coolant is circulated through the plenum for cooling the guide.

17 Claims, 3 Drawing Sheets

ELECTROSLAG APPARATUS AND GUIDE

BACKGROUND OF THE INVENTION

The present invention relates generally to electroslag refining, and, more specifically, to electroslag refining of superalloys.

Electroslag refining is a process used to melt and refine a wide range of alloys for removing various impurities therefrom. U.S. Pat. No. 5,160,532-Benz et al. discloses a basic electroslag refining apparatus over which the present invention is an improvement. Typical superalloys which may be effectively refined using electroslag refining include those based on nickel, cobalt, zirconium, titanium, or iron. The initial, unrefined alloys are typically provided in the form of an ingot which has various defects or impurities which are desired to be removed during the refining process to enhance metallurgical properties thereof including grain size and microstructure, for example.

In a conventional electroslag apparatus, the ingot is connected to a power supply and defines an electrode which is suitably suspended in a water cooled crucible containing a suitable slag corresponding with the specific alloy being refined. The slag is heated by passing an electric current from the electrode through the slag into the crucible, and is maintained at a suitable high temperature for melting the lower end of the ingot electrode. As the electrode melts, a refining action takes place with oxide inclusions in the ingot melt being exposed to the liquid slag and dissolved therein. Droplets of the ingot melt, fall through the slag by gravity and are collected in a liquid melt pool at the bottom of the crucible. The slag, therefore, effectively removes various impurities from the melt to effect the refining thereof.

The refined melt may be extracted from the crucible by a conventional segmented, cold-walled induction-heated guide (CIG). The refined melt extracted from the crucible in this manner provides an ideal liquid metal source for various solidification processes including, for example, powder atomization, spray deposition, investment casting, melt-spinning, strip casting, and slab casting.

In the exemplary electroslag apparatus introduced above, the crucible is conventionally water-cooled to form a solid slag skull on the surface thereof for bounding the liquid slag and preventing damage to the crucible itself as well as preventing contamination of the ingot melt from contact with the parent material of the crucible, which is typically copper. The bottom of the crucible typically includes a water-cooled, copper cold hearth against which a solid skull of the refined melt forms for maintaining the purity of the collected melt at the bottom of the crucible. The CIG discharge guide tube or downspout below the hearth is also typically made of copper and is segmented and water-cooled for also allowing the formation of a solid skull of the refined melt for maintaining the purity of the melt as it is extracted from the crucible.

A plurality of water-cooled induction heating electrical conduits surround the guide tube for inductively heating the melt for controlling the discharge flow rate of the melt through the tube. In this way, the thickness of the skull formed around the discharge orifice in the guide tube may be controlled and suitably matched with melting of the ingot for obtaining a substantially steady state production of refined melt which is drained by gravity through the guide tube.

The cold hearth and the guide tube of the conventional electroslag refining apparatus are relatively complex in structure, and are therefore expensive to manufacture. The guide tube typically joins the cold hearth in a conical funnel configuration, with the induction heating coils surrounding the outer surface of the funnel and the downspout through which the melt is drained from the crucible. Furthermore, each of the guide tube segments or fingers must also be suitably manufactured with internal cooling passages therein which adds to the complexity of the assembly and cost of manufacture.

The funnel-shaped guide tube is also subjected to substantial stress and strain during operation from its complex three-dimensional configuration and from the heating and cooling effects of the melt, coolant, and induction heating. The useful life of the guide tube is therefore limited, and repair and replacement thereof requires the disassembly of all components in the vicinity thereof to provide access thereto which results in a substantial down-time during a maintenance outage. And, the funnel-shaped guide tube requires complex manufacturing processes to build including specialty milling of the various components and fabrication and assembly thereof.

It is therefore desirable to reduce the complexity of the guide tube and adjoining cold hearth for reducing the cost of manufacture, and improving the assembly and disassembly thereof.

SUMMARY OF THE INVENTION

A melt guide is provided for enclosing a bottom of an electroslag refining crucible containing a melt of electroslag refined metal. The guide includes an upper plate sized to engage the crucible bottom for attachment thereto, and includes an upper orifice drain therethrough for draining by gravity the melt from the crucible. A lower plate is spaced below the upper plate to define a plenum therebetween, and includes a lower orifice drain therethrough. A downspout extends through the plenum in flow communication between the upper and lower drains, and includes a middle orifice drain. A heater surrounds the downspout for heating the melt drainable therethrough. And, a coolant is circulated through the plenum for cooling the guide.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
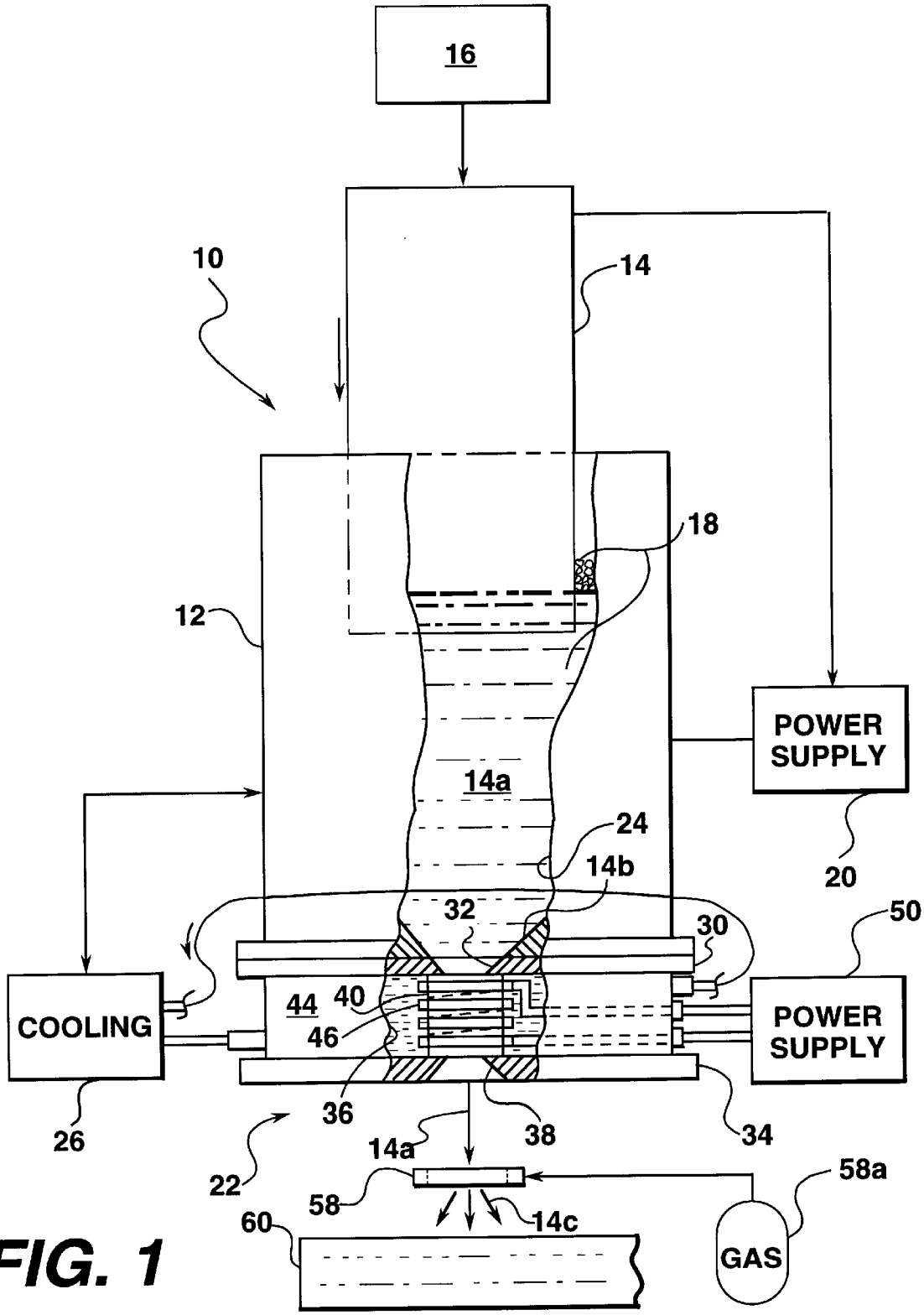
FIG. 1 is a schematic representation of an electroslag apparatus including an improved melt guide in accordance with an exemplary embodiment of the present invention for draining refined melt from a crucible.

Illustrated schematically in FIG. 1 is an electroslag refining apparatus 10 in accordance with a preferred and exemplary embodiment of the present invention. The apparatus 10 includes a cylindrical crucible 12 in which is suspended an ingot 14 of a suitable alloy for undergoing electroslag refining. Conventional means 16 are provided for feeding the ingot 14 into the crucible 12 at a suitable feedrate. The feeding means 16 may include, for example, a suitable drive motor and transmission which rotate a screw which in turn lowers or translates downwardly a support bar fixedly joined at one end to the top of the ingot 14.

The ingot 14 is formed of any suitable alloy requiring electroslag refining such as the superalloys listed above. A suitable slag 18 is provided inside the crucible 12 and may take any conventional composition for refining a specific material of the ingot 14. Conventional heating means 20 are provided for melting the tip of the ingot 14 as it is fed into the crucible 12. The melting or heating means 20 include a suitable electric current power supply electrically joined to the ingot 14 through the support bar by a suitable electrical lead. An electrical return path is provided to the power supply from the crucible 12 using another electrical lead. Electrical current is carried through the ingot 14, which defines an electrode, and through the slag 18, in liquid form, to the crucible 12. In this way, the slag 18 is resistively heated to a suitably high temperature to melt the bottom end of the ingot 14 suspended therein.

In accordance with the present invention, an improved melt guide 22 is removably attached to the bottom of the crucible 12 for providing a drain therefrom. As the slag 18 is heated by the power supply, the bottom tip of the ingot 14 is correspondingly heated and melted, with droplets of molten metal, or simply melt, 14*a* falling through the slag 18 and collecting in a liquid metal pool or reservoir 24 at the bottom of the crucible 12 which is bounded at its bottom end by the melt guide 22.

Suitable means 26 are provided for cooling the crucible 12 during operation. The cooling means 26 conventionally include a suitable coolant supply which is effective for pumping a coolant 28, such as water, around the crucible 12 through a cooperating water jacket thereof. The crucible 12 and cooling jacket may be an integrated assembly or discrete components as desired, with the cooling jacket having suitable channels or conduits extending therethrough through which the coolant is circulated for removing heat from the crucible 12 during operation.

In this way, a solid slag skull forms during operation inside the crucible 12 around the liquid slag 18 to isolate the crucible 12 from the liquid slag 18 and the metal droplets falling therethrough. Electroslag refining of the ingot 14 is accomplished as the metal droplets melting from the bottom end of the ingot 14 are exposed to the slag 18 which dissolves oxide inclusions therein. The crucible 12 is typically formed of copper and is isolated from the refining process by the solid slag skull, and therefore the crucible does not contaminate the ingot melt. The ingot melt 14*a* collects in the reservoir 24 at the bottom of the crucible 12 around which is also formed during operation a solid ingot skull 14*b* of solidified refined melt 14*a*. Again, the ingot skull 14*b* isolates the melt 14*a* from the crucible 12 and prevents contamination thereof. In operation, the liquid slag 18 floats atop the pool of refined melt 14*a* collected above the melt guide 22.

Figure 2:
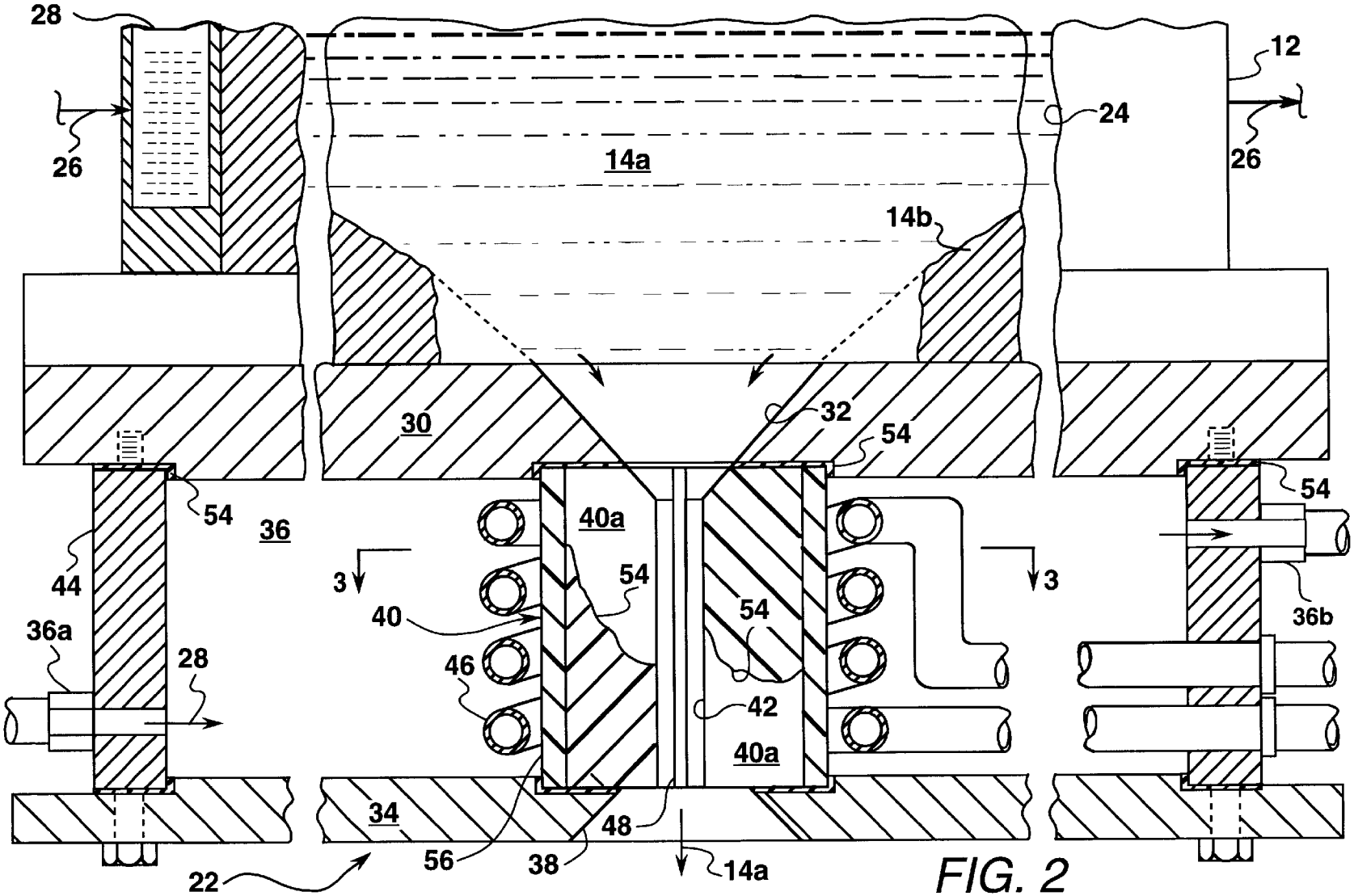
FIG. 2 is an enlarged, elevational sectional view of the melt guide illustrated in FIG. 1 attached to the bottom of the crucible in accordance with a preferred embodiment.

The melt guide 22 illustrated in FIG. 1 in accordance with an exemplary embodiment is substantially simpler in construction and manufacture when compared to a conventional funnel-shaped melt guide, and is substantially less expensive to manufacture and more readily assembled and disassembled when required, as well as providing effective operation in the electroslag refining process. FIG. 2 illustrates in more particularity an enlarged view of the melt guide 22 enclosing the bottom of the crucible 12. In this exemplary embodiment, the crucible 12 is a cylindrical member, with its bottom being in the form of an annular radial flange.

In its simplest embodiment, the melt guide 22 includes a flat upper plate 30 which may be made of copper, for example. The upper plate 30 is in the exemplary form of a circular disk to match the cylindrical crucible 12, and has a perimeter sized in diameter to engage the crucible bottom for sealed attachment thereto. Suitable means in the exemplary form of a plurality of circumferentially spaced apart fasteners or bolts and cooperating nuts (not shown) are provided for removably attaching the upper plate 30 to the crucible bottom in sealed contact therewith. A suitable gasket or seal may be provided between the upper plate 30 and the crucible bottom and is compressed therebetween upon assembly of the fasteners to secure the upper plate 30 to the bottom of crucible 12.

The upper plate 30 provides a cold hearth at the crucible bottom above which the refined melt is pooled in the reservoir 24. And, the upper plate 30 further includes a central upper orifice drain 32 extending vertically therethrough between the upper and lower surfaces thereof for draining by gravity the melt 14*a* from the reservoir 24.

The melt guide 22 also includes a flat lower plate 34, which may also be made of copper for example, which is spaced below the upper plate 30 to define a cooling manifold or plenum 36 therebetween. The lower plate 34 is in the exemplary form of a circular disk to match the upper plate 30, and also includes a central lower orifice drain 38 therethrough which is vertically aligned with the upper drain 32.

A cylindrical downspout 40 extends vertically through the plenum 36, and includes a middle orifice drain 42 disposed in flow communication between the upper and lower drains 32, 38 for channeling the melt 14*a* therethrough by gravity.

The downspout 40 defines the radially inner boundary of the plenum 36, and the radially outer boundary of the plenum 36 may be formed by suitable vertical extensions of the upper or lower plate, or both. In the exemplary embodiment illustrated in FIG. 2, the upper and lower plates 30, 34 are sealingly joined together by an annular or cylindrical sidewall 44 which may also be copper, or stainless steel since it is located remote from the downspout 40. The sidewall 44 extends circumferentially around the perimeters of the upper and lower plates 30, 34 and is suitably fixedly joined therebetween by a plurality of fasteners such as bolts which clamp the lower plate 34 against the sidewall 44 and in turn against the bottom of the upper plate 30.

The melt guide 22 enjoys considerable simplicity of construction and manufacture as compared to the conventional funnel shaped CIGs. The guide 22 is formed of simple components which are readily manufacturable. The upper and lower plates 30, 34 are simple circular disks which are solid and do not require internal cooling passages therethrough as found in the CIGs. Cooling is instead effected by providing the enclosed plenum 36 between the upper and lower plates through which the coolant 28 may be suitably circulated. Either the same cooling means 26 illustrated in FIG. 1 for cooling the crucible 22 may be used for also cooling the melt guide 22, or an analogous dedicated cooling means may be specifically configured therefor.

As illustrated in FIG. 2, the plenum 36 includes an inlet 36*a* and an outlet 36*b* in the form of fluid fittings mounted through the sidewall 44 and disposed in flow communication with the cooling means 26 of FIG. 1 using corresponding flow conduits. The coolant 28 is then pumped through the plenum 36 during operation for continuously removing heat from the various components of the melt guide 22 itself including in particular the upper plate 30.

The upper plate 30 is directly attached to the bottom of the crucible 12 and receives heat from the melt 14*a*. The upper plate 30 is preferably made of copper for its high heat conductivity which transfers the heat into the coolant 28 circulating within the plenum 36. Similarly, heat from the melt 14*a* draining through the downspout 40 is carried by conduction through the downspout 40 into the surrounding coolant 28 in the plenum 36 for removal.

In order to heat the melt 14*a* as it drains through the downspout 40 to prevent undesirable solidification and clogging thereof, the downspout 40 is preferably segmented, and suitable means, or heater, in the exemplary form of an induction coil 46 are disposed inside the plenum 36 and surround the downspout 40 for heating the melt 14 which drains therethrough during operation.

Figure 3:
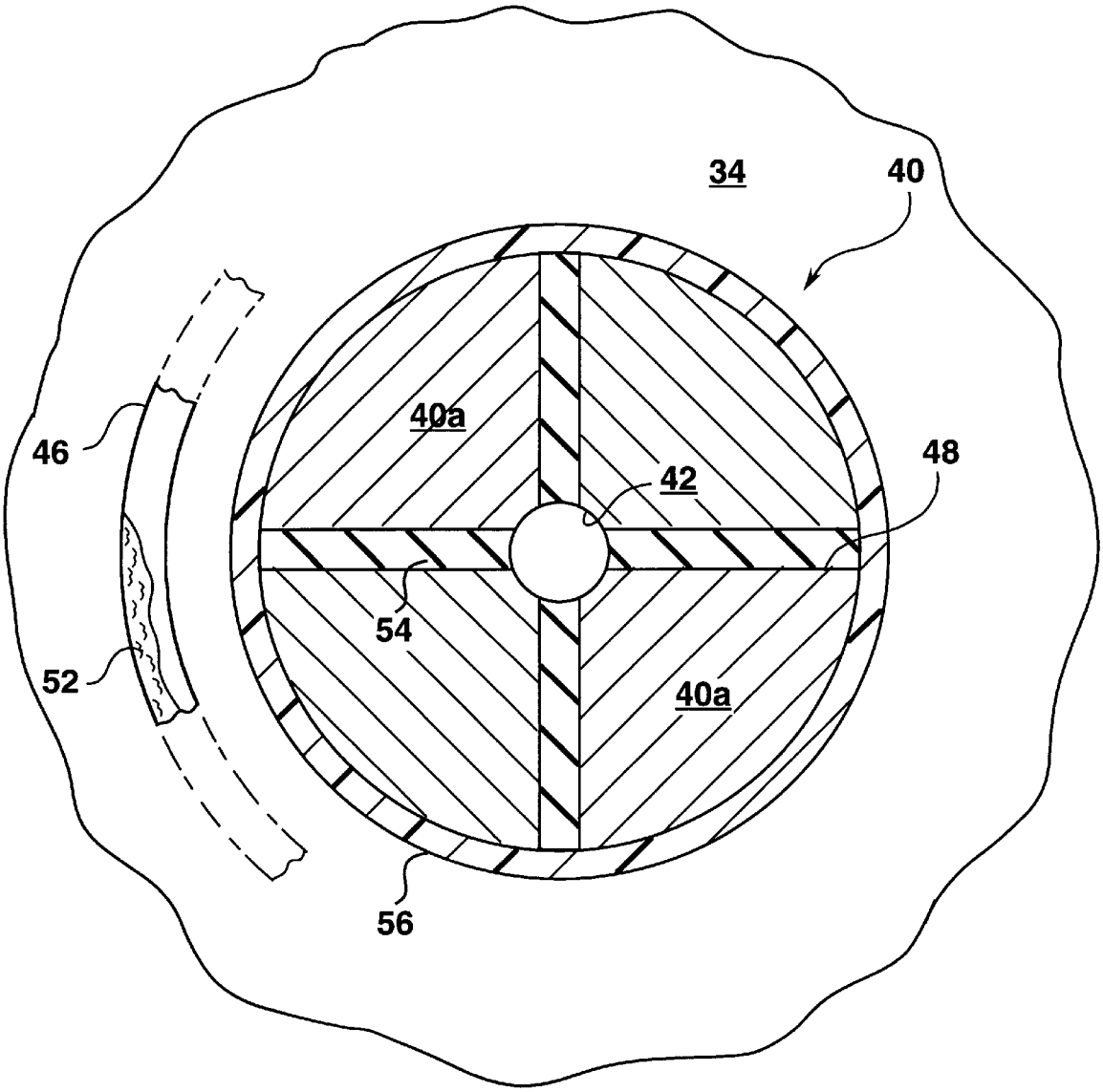
FIG. 3 is a top, partly sectional view of the melt guide illustrated in FIG. 2 and taken generally along line 3—3.

The downspout 40 is illustrated in more particularity in FIG. 3 as including a plurality of discrete arcuate segments 40*a,* four for example, which define fingers circumferentially spaced apart from each other at corresponding radial through slots 48. The induction coil 46 is disposed inside the plenum 36 and circumferentially surrounds the downspout segments 40*a* for radiating electromagnetic energy through the slots 48 and into the draining melt 14*a* as it flows through the middle drain 42.

The induction coil 46 may take any conventional form such as a tubular electrical conductor which spirals around the downspout 40 illustrated in FIG. 1 and includes corresponding integral extensions which extend outwardly through the sidewall 44 to a conventional electrical power supply 50 disposed outside the melt guide 22. The power supply 50 also includes an integrated cooling circuit for channeling a coolant such as water through the induction coil 46 for removing heat generated during operation. The induction coil 46 and its power and cooling supply 50 may take any conventional form. However, since the induction coil 46 is mounted inside the coolant filled plenum 36, it preferably includes a water impermeable and electrically insulating coating or sheath 52, such as epoxy as shown in part in FIG. 3, to protect the coil 46 from electrical shorting in the coolant 28 during operation.

Since the upper and lower plates 30, 34, the downspout 40, and the sidewall 44 collectively define the plenum 36 through which the coolant 28 is circulated, they are also suitably sealed together at respective joints using a sealant or gasket 54, which may be rubber for example, to prevent coolant leakage during operation. Suitable sealing is also provided at the plenum inlet 36*a* and outlet 36*b,* and for the coil extensions through the sidewall 44 to the power supply 50.

In the exemplary embodiment illustrated in FIGS. 2 and 3, an annular band 56 surrounds the downspout segments 40*a* to collectively form a cylinder for providing structural integrity of the downspout 40 for accommodating loads created during operation. The band 56 may be formed of fiberglass fibers or fabric in a suitable epoxy matrix which provides both structural integrity as well as a seal for preventing leakage of the coolant 28 between the segment slots 48 during operation. The band also allows transmission of the electromagnetic radiation from the induction heating coil 46 during operation. The segment slots 48 may be empty or filled with a suitable electrical insulator such as the rubber sealant 54, polymer, or epoxy for allowing transmission of the induction heating energy therethrough and into the melt 14*a* draining through the middle drain 42 during operation.

In the preferred embodiment illustrated in FIGS. 2 and 3, the upper and lower plates 30, 34 are solid and not necessarily segmented, with segments being provided in the discrete downspout 40 through which electromagnetic radiation is transmitted from the induction coil 46 during operation. This operation is analogous with the conventional CIG described above, yet is effected in a substantially simpler assembly of components for achieving substantial cost reductions. Internal cooling channels within the upper and lower plates 30, 34 are not required, with these plates being instead cooled by conduction into the plenum coolant 28.

Since the melt 14 drained through the melt guide 22 is at an elevated temperature, both the upper and lower drains 32, 38 are preferably wider in diameter than the middle drain 42 to reduce or prevent heat extraction from the melt 14*a* and into the plate. The upper drain 32 is preferably conical and converges downwardly to the middle drain 42, and engages the middle drain 42 conically in upper part thereof. A common cone is therefore defined between the upper drain 32 and the upper portion of the middle drain 42 for guiding the melt 14*a* during draining. And, heat extraction from the melt 14*a* is thereby reduced.

The lower drain 38 is wider in diameter than the middle drain 42 at its exit, and is also preferably spaced radially outwardly from the middle drain 42 for reducing or preventing heat extraction from the melt 14*a* discharged from the melt guide 22. It is desired to maintain maximum temperature of the melt 14*a* as it is discharged through the melt guide 22 for subsequent use.

As illustrated in FIG. 1, the improved melt guide 22 operates in combination with the crucible 12 in the electroslag refining apparatus 10. The ingot electrode 14 is continually lowered into the crucible 12 during operation and heated for producing the melt 14*a* under steady state conditions with a continuous discharge of the melt 14*a* through the melt guide 22. Conventional means 58 are disposed below the melt guide 22 for atomizing the melt 14*a* discharged from the lower drain 38 into an atomized melt stream 14*c*. The atomizing means 58 may take any conventional form including an atomizing ring through which the melt 14*a* drops, with the ring including a plurality of circumferentially spaced apart outlets through which an atomizing gas 58*a* is ejected for forming the atomized melt stream 14*c*. The atomized stream 14*c* is directed atop a suitable preform 60, such as a cylinder, for spray deposition of the refined superalloy thereon.

The conical lower drain 38 which diverges downwardly away from the middle drain 42 reduces heat extraction in the discharged melt 14*a* for promoting the spray deposition process. An additional advantage of the improved melt guide 22 is the inherent protection of the induction coil 46 inside the plenum 36 by the lower plate 34 which prevents undesirable accumulation of backspray of the melt stream 14*c* onto the induction coil 46 which would reduce its useful life.

The simplicity of the melt guide 22 substantially decreases its cost of manufacture, including decreasing the cost of assembly and disassembly thereof. The upper plate 30 may be readily replaced during a maintenance outage by simply disassembling its fasteners and removing the entire melt guide 22 for refurbishment. The lower plate 32 and induction coil 46 may also be readily removed and replaced as desired.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A melt guide for enclosing a bottom of an electroslag refining crucible containing a melt of electroslag refined metal comprising:

an upper plate sized to engage said crucible bottom for attachment thereto, and having an upper orifice drain therethrough for draining by gravity said melt from said crucible;

a lower plate spaced below said upper plate to define a plenum therebetween, and having a lower orifice drain therethrough;

a downspout extending through said plenum, and including a middle orifice drain in flow communication between said upper and lower drains for channeling said melt therethrough;

a heater surrounding said downspout for heating said melt drainable therethrough; and means for circulating a coolant through said plenum.

2. A guide according to claim 1 wherein:

said downspout is segmented; and said heater comprises an induction coil for induction heating said melt draining through said downspout.

3. A guide according to claim 2 wherein:

said downspout includes a plurality of segments circumferentially spaced apart at a corresponding slot; and said slot is filled with a sealant for transmitting electromagnetic radiation from said coil to heat said melt drained through said downspout.

4. A guide according to claim 3 further comprising an annular band surrounding said downspout segments.

5. A guide according to claim 3 wherein:

said upper and lower plates are joined together by a sidewall extending around perimeters thereof; and said coil is disposed inside said plenum.

6. A guide according to claim 5 wherein said upper and lower plates are solid and substantially flat.

7. A guide according to claim 3 wherein said lower drain is wider than said middle drain.

8. A guide according to claim 3 wherein said upper drain is conical and engages said middle drain conically in upper part thereof.

9. A guide according to claim 3 in combination with said crucible to define an electroslag refining apparatus, and further comprising:

means for cooling said crucible;

means for feeding an ingot into said crucible; and means for melting said ingot in said crucible to form said melt.

10. An apparatus according to claim 9 further comprising means for atomizing said melt discharged from said lower drain.

11. An electroslag refining apparatus comprising:

a cylindrical crucible having an annular bottom flange;

means for melting an ingot and slag in said crucible for electroslag refining said ingot melt with said slag melt;

an upper plate fixedly joined to said flange for pooling thereabove said electroslag refined melt, and having an upper orifice drain for draining therethrough by gravity said melt;

a lower plate spaced below said upper plate to define a plenum therebetween, and having a lower orifice drain therethrough;

a downspout extending through said plenum, and including a middle orifice drain in flow communication with said upper and lower drains for channeling said melt therethrough in turn;

a heater surrounding said downspout for heating said melt drainable therethrough; and means for circulating a coolant through said plenum.

12. An apparatus according to claim 11 wherein said plenum extends across said flange for cooling said upper plate to effect a cold hearth for said crucible.

13. An apparatus according to claim 12 wherein said downspout is disposed inside said plenum for being cooled by said coolant.

14. An electroslag refining melt guide for enclosing a bottom of an electroslag refining crucible containing a melt of electroslag refined metal atop a solidified skull thereof comprising:

an upper plate having an upper orifice drain;

a lower plate having a lower orifice drain; and a downspout having a middle orifice drain joined at opposite ends to said upper and lower drains for draining said melt downwardly therethrough in turn.

15. A guide according to claim 14 further comprising a heater surrounding said downspout for heating said melt drainable therethrough.

16. A guide according to claim 15 wherein said lower plate is spaced below said upper plate to define a plenum therebetween, and further comprising means for circulating a coolant through said plenum.

17. A guide according to claim 16 wherein said downspout is circumferentially segmented, and further comprising an annular band therearound.

* * * * *